US007432758B2

(12) United States Patent
Chou et al.

(10) Patent No.: US 7,432,758 B2
(45) Date of Patent: Oct. 7, 2008

(54) VOLTAGE REGULATOR FOR SEMICONDUCTOR MEMORY

(75) Inventors: Min-Chung Chou, Hsinchu (TW); Tse-Hua Yao, Kellung (TW)

(73) Assignee: Elite Semiconductor Memory Technology Inc., Hsinchu (TW)

( * ) Notice: Subject to any disclaimer, the term of this patent is extended or adjusted under 35 U.S.C. 154(b) by 23 days.

(21) Appl. No.: 11/557,503

(22) Filed: Nov. 8, 2006

(65) Prior Publication Data

US 2008/0122415 A1 May 29, 2008

(51) Int. Cl.
*G05F 3/02* (2006.01)

(52) U.S. Cl. ..... 327/540; 327/541; 327/543; 323/277; 323/282

(58) Field of Classification Search ..... 327/540, 327/543, 541, 542; 323/277, 282
See application file for complete search history.

(56) References Cited

U.S. PATENT DOCUMENTS 5,249,155 A * 9/1993 Arimoto et al. ..... 365/222
5,352,935 A * 10/1994 Yamamura et al. ..... 327/540
5,821,808 A * 10/1998 Fujima ..... 327/541
5,831,421 A * 11/1998 Taira et al. ..... 323/314
6,072,742 A * 6/2000 Ooishi ..... 365/226
6,184,744 B1 * 2/2001 Morishita ..... 327/541
6,351,426 B1 * 2/2002 Ohsawa ..... 365/226
6,664,773 B1 * 12/2003 Cunnac et al. ..... 323/277
6,806,692 B2 10/2004 Lee
7,095,272 B2 * 8/2006 Morishita ..... 327/541
7,142,044 B2 * 11/2006 Sano ..... 327/540

FOREIGN PATENT DOCUMENTS

TW 473730 1/2002

* cited by examiner

*Primary Examiner*—Kenneth B. Wells
(74) *Attorney, Agent, or Firm*—Jianq Chyun IP Office

(57) ABSTRACT

A voltage regulator as a stable power supply to internal circuits in a semiconductor memory device is provided. This regulator includes a comparing unit, a first driver transistor, a feedback unit, an auxiliary control unit, a first switch, a second switch, and a second driver transistor. The comparing unit compares a reference voltage with a feedback signal to control the first driver transistor and maintain the internal power supply at a stable level. The second driver transistor, controlled by the first and second switches responsive to a trigger signal corresponding abrupt current consumptions and the auxiliary control unit responsive to the comparing result, supplies sufficient and appropriate current to the internal circuits and prevents the internal power supply from excessive overshoot and drop-out.

10 Claims, 3 Drawing Sheets

VOLTAGE REGULATOR FOR SEMICONDUCTOR MEMORY

BACKGROUND OF THE INVENTION

1. Field of Invention

The present invention relates to a voltage regulator, and more particularly to a voltage regulator for semiconductor memories such as dynamic random access memory (DRAM) and static random access memory (SRAM)

2. Description of Related Art

Along with the rapid development of science and technology at the present, semiconductor memories, as major storage devices for large amount of data are being developed to have larger and larger capacity. As the semiconductor technology is continuously scaled down to achieve high memory density, on-chip voltage regulators providing lower supply voltage for internal circuits are required to fulfill the requirements for device reliability and low power consumption. For DRAM, the bit line sensing, restoring and pre-charge operations in the memory cell arrays consume current abruptly and heavily. For high density DRAM chip, it is challenging to design on-chip voltage regulators for memory cell arrays providing a stable voltage level (Vsa) with sufficient and appropriate supplying current.

FIG. 1 is a circuit diagram of a conventional voltage regulator 100 for DRAM. The voltage regulator 100 includes a differential amplifier unit 11 as a comparator, a feedback unit 12, a PMOS driver transistor mp11, and a NMOS transistor 13.

The differential amplifier unit 11 includes a plurality of transistors 111~115. NMOS transistor 112 is connected in series with PMOS transistor 114. NMOS transistor 113 is connected in series with PMOS transistor 115. NMOS transistor 111 has its drain connected to the sources of both NMOS transistors 112 and 113, and its source connected to GND. The NMOS transistor 111, which gate is connected to a voltage Vbias1, provides a constant current for the differential amplifier unit 11. The NMOS transistor 112 detects the Vsa1 level from the feedback unit 12 and NMOS transistor 113 receives a reference voltage Vref1. The PMOS transistors 114 and 115, whose gates are connected together, constitute a current mirror. The PMOS transistor 114 has its gate and drain connected together and its source connected to a power supply Vdd. The PMOS transistor 115 is connected between the power supply Vdd and the differential amplifier unit 11 output node. The PMOS driver mp11, whose gate is connected to the differential amplifier unit 11 output, control the currents supplied from the power supply Vdd to the Vsa1 for internal circuit (not shown). The feedback unit 12, having a plurality of resistors R11 and R12, adjusts the ratio of Vsa1 to the reference voltage Vref1. The feedback output voltage Vfb1, is equal to Vsa1*R12/(R11+R12). NMOS transistor 13, normally turned off, is turned on by a rising trigger signal tr1 to pull the gate of PMOS driver transistor mp11 toward ground (GND) and supply more current to Vsa1.

In operation, the differential amplifier unit 11 compares the feedback voltage Vfb1 with a reference voltage Vref1, and then applies the output signal to the gate of PMOS driver transistor mp11 to control the current and regulate the internal power supply Vsa1 for DRAM cell array. If Vsa1 is lower and Vfb1 is less than Vref1, the gate of PMOS driver transistor mp11 will attain toward ground to raise Vsa1. While Vsa1 is getting higher, Vfb1 is rising toward Vref1 and the gate of PMOS driver transistor mp11 will attain toward Vdd to turn off PMOS driver transistor mp11 and stop the Vsa1 rising. In steady state, Vfb1 is equal to Vref1 and Vsa1 is regulated at Vref1*(R11+R12)/R12.

To prevent the excessive drop-down of Vsa1 during bit line sensing, which degrades the DRAM performance, the NMOS transistor 13, turned on and controlled by a trigger signal tr1, pulls down the gate voltage of PMOS driver transistor mp11 toward GND to supply more current and raise the Vsa1 level in advance. This "pre-kick" action prevents some excessive drop-down of Vsa1 voltage at bit line sensing afterwards. Due to lack of a proper feedback mechanism from Vsa1 in controlling the "pre-kick" and slow response of the differential amplifier unit 11, Vsa1 is easier to be raised and dropped excessively.

According to U.S. Pat. No. 6,806,692 B2, a voltage down converter for supplying a voltage and current to semiconductor devices is provided. The voltage down converter resolves several problems of the above conventional voltage regulator 100 for semiconductor memories. However, the voltage down converter, having two amplifiers, is more complex and has higher manufacturing cost.

SUMMARY OF THE INVENTION

An objective of the present invention is to provide a voltage regulator for semiconductor memory, which offers sufficient current supply and stable voltage supply for semiconductor memory.

Another objective of the present invention is to provide a voltage regulator for semiconductor memory, which is simpler in circuit than the prior art, resulting reduced manufacturing cost.

The present invention provides a voltage regulator for semiconductor memories, such as DRAM and SRAM, which includes the following: a comparing unit, a first driver transistor, a feedback unit, an auxiliary control unit, a first switch, a second switch, and a second driver transistor. The comparing unit, used as a differential amplifier, amplifying the voltage difference between a first signal and a reference voltage, generating a larger swing signal at the comparing unit output and a less varying complementary amplifying signal at the drain of the diode-connected PMOS. The first driver transistor for outputting an internal supply voltage is coupled to the comparing unit, and receives the comparing unit output signal. The feedback unit receives the internal supply voltage and generates the first signal, proportional to the internal supply voltage, to the comparing unit. The first switch is coupled to the auxiliary control unit and to a supply voltage for raising the control voltage up to the supply voltage. The second switch is coupled to the auxiliary control unit and to a second reference voltage, for dropping the control voltage down to the second reference voltage. The second driver transistor has a second control terminal coupled to the control voltage, a second output terminal coupled to the supply voltage, and the other second output terminal coupled to the first driver transistor for outputting the internal supply voltage for the semiconductor memory.

In the present invention, the second driver transistor controlled by a control voltage which is affected by the auxiliary control unit and responsive to abrupt current load consumptions, supplies sufficient current to the internal circuits and prevents the internal power supply from excessive overshoot and/or drop-out.

In order to make the aforementioned and other objects, features and advantages of the present invention comprehensible, preferred embodiments are accompanied with figures are described in detail below.

DESCRIPTION OF EMBODIMENTS

The embodiments of the present invention are described below with reference to the accompanied figures, where DRAM is taken as an example in the embodiments to illustrate the operating principle of the present invention. However, the embodiments of the present invention are not limited to the DRAM, i.e., any memory unit in this field is also suitable to be used in the present invention, such as static random access memory (SRAM) and other random access memories (RAM).

Figure 1:
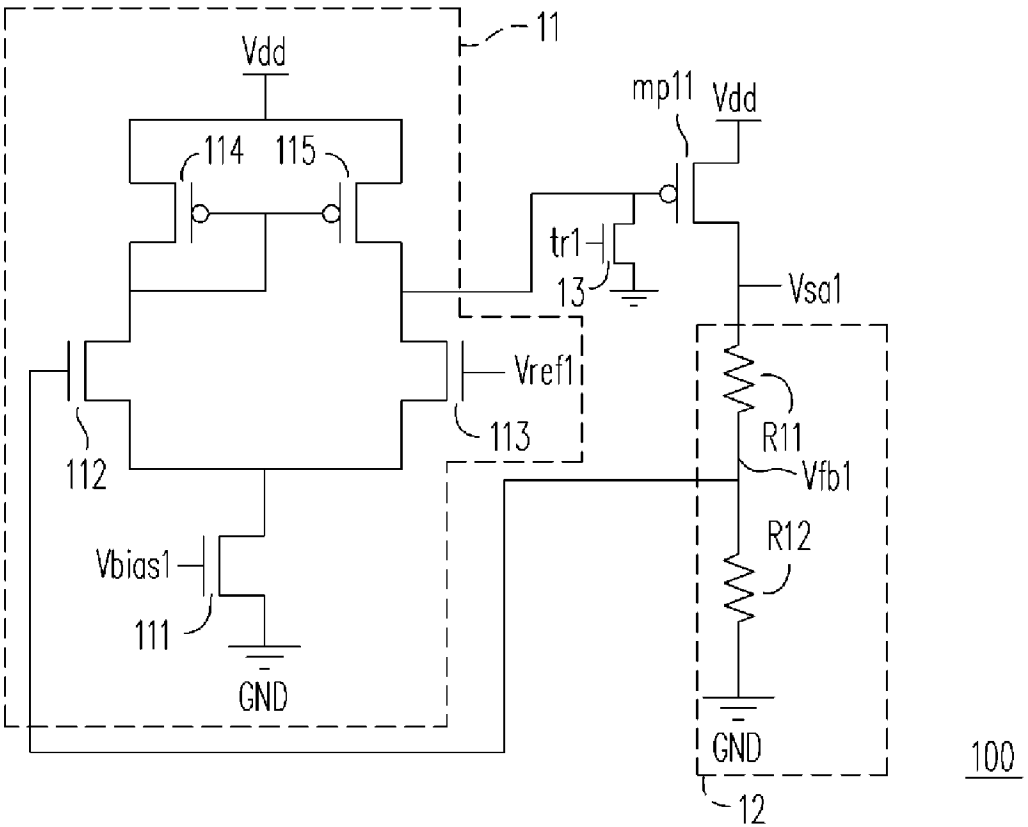
FIG. 1 (PRIOR ART)
FIG. 1 is a circuit diagram of a conventional voltage regulator 100 for DRAM.
Figure 2:
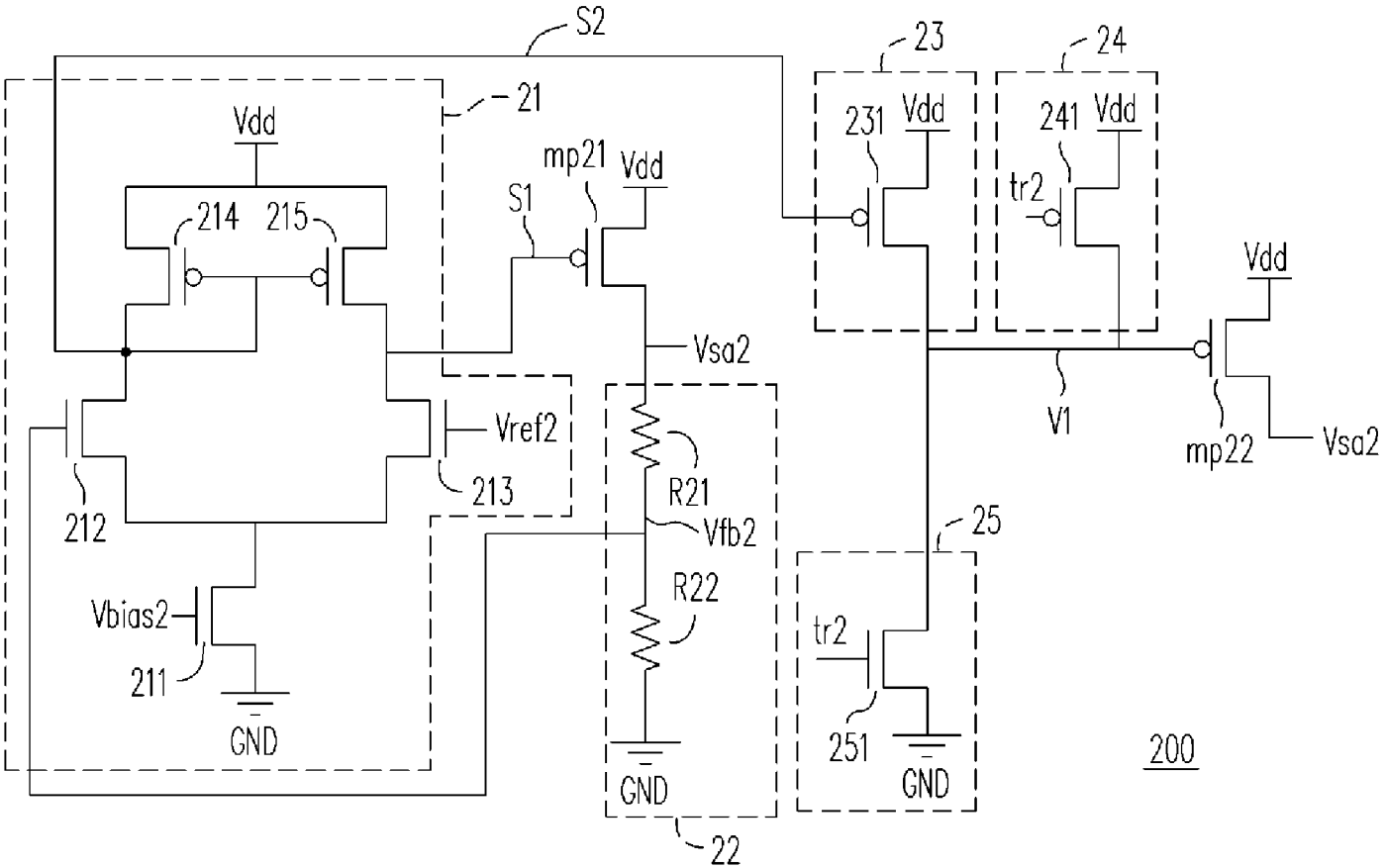
FIG. 2 is a circuit diagram of a voltage regulator 200 for DRAM according to an embodiment of the present invention.

FIG. 2 is a circuit diagram of a voltage regulator 200 for DRAM according to an embodiment of the present invention. The voltage regulator 200 for DRAM includes a comparing unit 21, a first PMOS driver transistor mp21, a feedback unit 22, an auxiliary control unit 23, a first switch 24, a second switch 25, and a second PMOS driver transistor mp22. The comparing unit 21, as a differential amplifier, includes a plurality of NMOS transistors 211-213 and a plurality of PMOS transistors 214-215. The comparing unit 21 differentiates a first signal from the feedback unit 22 with a voltage reference Vref2 to output a large swing amplifying signal S1 and a smaller swing complementary amplifying signal S2. The NMOS transistor 211 receives a gate voltage bias2 and supplies a biasing current for the comparing unit 21. The amplifying signal S1 controls the first PMOS drive transistor mp21 to output an internal supply voltage Vsa2 for DRAM memory cells. The smaller swing complementary amplifying signal S2, output from the drain of the diode-connected PMOS transistor 214, controls the auxiliary control unit 23. The feedback unit 22, including resistors R21 and R22, receives the Vsa2 voltage and generates a first signal Vfb2, determined by the impedance ratio of R21 to R22, to an input of the comparing unit 21. The first PMOS driver transistor mp21 provides a first output terminal coupled to the power supply (Vdd), a second control path (or referred as a second output terminal) to the internal supply voltage Vsa2 and the second PMOS driver transistor mp22 provides a third output terminal coupled to the power supply and a fourth control path (or referred as a fourth output terminal) to the internal supply voltage Vsa2. The auxiliary control unit 23, includes a third PMOS transistor 231, and is coupled to the comparing unit 21, wherein the third PMOS transistor 231 has a fifth output terminal coupled to the second control terminal of the second PMOS driver transistor mp22. The auxiliary control unit 23 receives the smaller swing complementary amplifying signal S2 to output a control voltage V1 to the gate of the second PMOS driver transistor mp22. The first switch 24, which includes a PMOS transistor 241 with a sixth output terminal coupled to the power supply and a seventh output terminal coupled to the second PMOS driver transistor mp22, receives a trigger signal tr2 for raising the control voltage V1 toward the power supply voltage Vdd. The second switch 25, including an NMOS transistor 251 with an eighth output terminal coupled to ground and a ninth output terminal coupled to the second PMOS driver transistor mp22, and receives the trigger signal tr2 to drop the control voltage V1 toward the ground voltage. Those skilled in the art should understand that the first switch 24 is not limited to comprise the PMOS transistor 241, but also may include any device which can raise the control voltage V1, such as a BJT (bipolar junction transistor) with a power voltage line; and the second switch 25 is not only limited to comprise the NMOS transistor 251, but also may include any devices which can drop the control voltage V1, such as a BJT with a ground voltage line.

In normal operation without abrupt change in current consumption, Vsa2 is regulated at Vref2*(R21+R22)/R22 by the comparing unit 21, the first PMOS driver transistor mp21 and the feedback unit 22. The output signal S1 of the comparing unit 21 is biased at a certain level such that the first PMOS driver transistor just supplies the quiescent Vsa2 standby current. The complementary amplifying signal S2, which is the gate bias of the current mirror PMOS transistors 214-215, sets the gate bias of the third PMOS transistor 231. The control voltage V1 applied to the gate of the second PMOS drive transistor mp22 is set at VDD until the trigger signal tr2 is rising.

Prepared for abrupt current consumption during the bit line sensing, the NMOS transistor 251, turned on by a rising trigger signal tr2, pulls down the gate voltage V1 of the second PMOS driver transistor mp22 to raise the internal supply voltage Vsa2 in advance. This "pre-kick" action prevents the excessive drop-down of the internal supply voltage Vsa2. The PMOS transistor 231, which is controlled by the complementary amplifying signal S2 from the comparing unit 21, holds the control voltage V1 and retrains the pre-kick on the internal supply voltage Vsa2. After the pre-kick, a falling trigger signal tr2 turns-off the NMOS transistor 251 and turns on the PMOS transistor 241, which raises the control voltage V1 to VDD to shut off the second PMOS driver transistor mp22. Those skilled in the art should understand that the auxiliary control unit 23 is not limited to include the PMOS transistor 231, but also includes any devices conducted by the complementary amplifying signal S2, such as a PMOS transistor or BJT.

Figure 3:
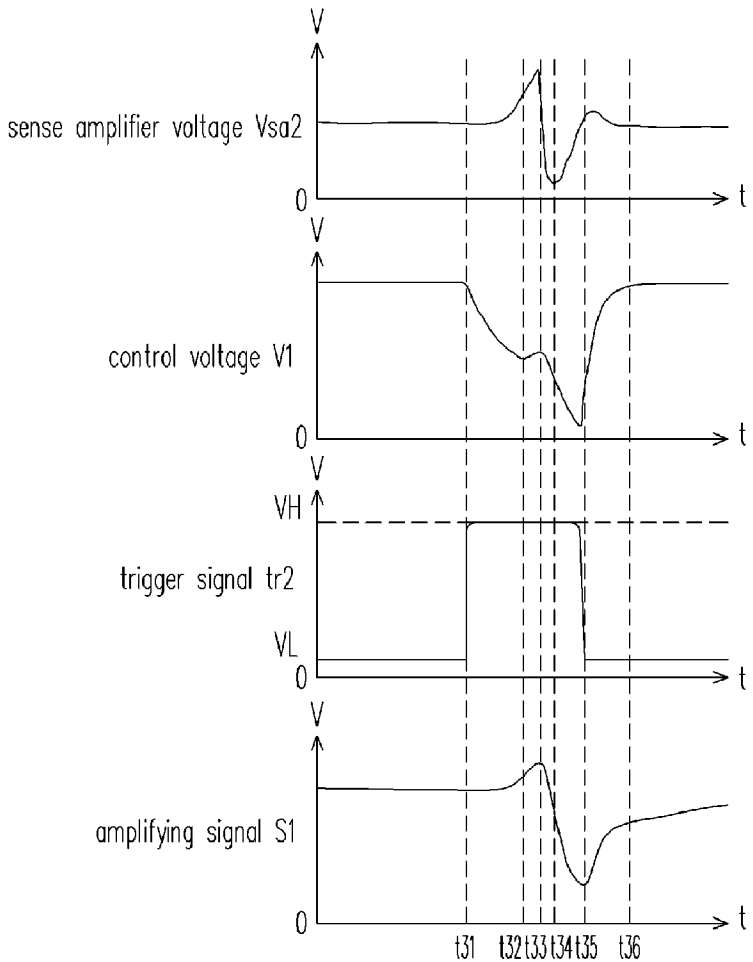
FIG. 3 is a timing diagram of the voltage regulator 200 according to the embodiment of the present invention.

FIG. 3 is a timing chart of the voltage regulator 200 illustrated in FIG. 2. The horizontal axis represents the time, and the vertical axis represents the voltage. The bit line sensing operation in DRAM is from time t33 to time t36, therefore, from time t33 to time t34, the internal supply voltage Vsa2 drops down enormously. From time t31 to time t35, the trigger signal tr2 stays at a high voltage VH to enable the NMOS transistor 251. From time t31 to time t32, the control voltage V1 is dropped down, and the internal supply voltage Vsa2 is raised up from a standby voltage. From time t32 to time t33, the auxiliary control unit 23 holds the control voltage V1 to prevent the internal supply voltage Vsa2 from being too high. From time t33 to time t34, the internal supply voltage Vsa2 drops down enormously during bit line sensing and the complementary amplifying signal S2 is rising, the auxiliary control unit 23 drive is weaker and the control voltage V1 is dropped lower by the second switch 25. From time t34 to time t35, the second PMOS driver transistor mp22 drives stronger to raise Vsa2 up and prevent heavy Vsa2 drop. From time t35 to time t36, the trigger signal tr2 returns to a low voltage VL, the PMOS transistor 241 raises the control voltage V1 to Vdd to shut down the second PMOS driver transistor and prevent Vsa2 overshoot.

In summary, as the auxiliary control unit regulates the control voltage of the second PMOS driver transistor at pre-kick responsive for abrupt high current consumption, the output of the comparing unit, isolated from the pre-kick switches, controls the primary first PMOS drive transistor. This new regulator with separated driver transistors controlled by separate signals provides a stable Vsa voltage level with sufficient and appropriate supplying current without much additional cost.

Though the present invention has been disclosed above by the preferred embodiments, they are not intended to limit the invention. Anybody skilled in the art can make some modifications and variations without departing from the spirit and scope of the invention. Therefore, the protecting range of the invention falls in the appended claims.

What is claimed is:

1. A voltage regulator in a semiconductor memory device, comprising:

a comparing unit, for receiving a first signal and a first reference voltage to output an amplifying signal and a complementary amplifying signal;

a first driver transistor, coupled to the comparing unit, having a first control terminal for receiving the amplifying signal, a first output terminal for coupling to a supply voltage, and a second output terminal for outputting an internal supply voltage;

a feedback unit, coupled to the second output terminal of the first driver transistor, for receiving the internal supply voltage to generate the first signal proportional to the internal supply voltage and to output the first signal to the comparing unit;

an auxiliary control unit, coupled to the comparing unit, for receiving the complementary amplifying signal for outputting a control voltage corresponding to the complementary amplifying signal;

a first switch, coupled to the auxiliary control unit and to the supply voltage, for raising the control voltage up to the supply voltage;

a second switch, coupled to the auxiliary control unit and coupled to a second reference voltage, for dropping the control voltage down to the second reference voltage, wherein the first switch and the second switch are turned on by a trigger signal when a bit line sensing operation is performed; and a second driver transistor, having a second control terminal coupled to the auxiliary control unit, a third output terminal coupled to the supply voltage, and a fourth output terminal coupled to the second output terminal of the first driver transistor for outputting the internal supply voltage.

2. The voltage regulator in a semiconductor memory device according to claim 1, wherein the auxiliary control unit further comprises a third driver transistor, which couples to the comparing unit, having a third control terminal coupled to the comparing unit for receiving the complementary amplifying signal, and having a fifth output terminal coupled to the second control terminal of the second driver transistor for outputting the control voltage.

3. The voltage regulator in a semiconductor memory device according to claim 2, wherein the third driver transistor is a PMOS (Metal Oxide Semiconductor) transistor.

4. The voltage regulator in a semiconductor memory device according to claim 1, wherein the first switch further comprises a fourth driver transistor, which couples to the auxiliary control unit, having a fourth control terminal to receive the trigger signal, and having a sixth output terminal coupled to a supply voltage and a seventh output terminal coupled to the second control terminal of the second driver transistor for raising the control voltage; and the second switch further comprising a fifth driver transistor, which couples to the auxiliary control unit, having a fifth control terminal in order to receive the trigger signal, and having an eighth output terminal coupled to the second reference voltage and a ninth output terminal coupled to the second control terminal of the second driver transistor for dropping the control voltage.

5. The voltage regulator in a semiconductor memory device according to claim 4, wherein the fourth driver transistor is a PMOS transistor and the fifth driver transistor is an NMOS transistor.

6. The voltage regulator in a semiconductor memory device according to claim 1, wherein the first driver transistor is a PMOS transistor.

7. The voltage regulator in a semiconductor memory device according to claim 1, wherein the second driver transistor is a PMOS transistor.

8. The voltage regulator in a semiconductor memory device according to claim 1, wherein the second reference voltage is a ground voltage.

9. The voltage regulator in a semiconductor memory device according to claim 1, wherein the memory device is DRAM (dynamic random access memory).

10. The voltage regulator in a semiconductor memory device according to claim 1, wherein the memory device is SRAM (static random access memory).

* * * * *